US005898261A

United States Patent [19]

Barker

[11] Patent Number: 5,898,261

[45] **Date of Patent: *Apr. 27, 1999**

[54] FLUID-COOLED PARTICLE-BEAM TRANSMISSION WINDOW

[75] Inventor: Robert J. Barker, Fairfax, Va.

[73] Assignee: The United States of America as represented by the Secretary of the Air Force, Washington, D.C.

[ * ] Notice: This patent issued on a continued prosecution application filed under 37 CFR 1.53(d), and is subject to the twenty year patent term provisions of 35 U.S.C. 154(a)(2).

[21] Appl. No.: 08/594,932

[22] Filed: Jan. 31, 1996

[51] Int. Cl.[6] ..... H01J 33/04

[52] U.S. Cl. ..... 313/420; 313/46; 313/35; 313/20; 313/33

[58] Field of Search ..... 313/420, 20, 22, 313/33, 35, 36, 44, 46; 315/500, 502, 503; 250/492.3, 505.1, 442.1; 373/230, 359.1

[56] References Cited

U.S. PATENT DOCUMENTS 4,409,511 10/1983 Loda et al. ..... 313/34
4,455,561 6/1984 Boyden et al. ..... 313/420 X
4,494,036 1/1985 Neukermans ..... 313/420
5,235,239 8/1993 Jacob et al. ..... 313/363.1
5,416,440 5/1995 Lyons et al. ..... 315/500

*Primary Examiner*—Ashok Patel
*Attorney, Agent, or Firm*—Thomas C. Stover

[57] ABSTRACT

High fluence charged-particle beams are generated in a vacuum or near vacuum environment. To use these beams in an atmospheric pressure environment, they must pass through some form of transmission window between the two environments. To date, thin single metal foils have been used for these transmission windows. The total practical fluence of such transmitted beams is limited by the ability of the window to dissipate the excess heat deposited in it by the transiting beam. Existing windows have relied only on simple radial heat conduction through the thin foil, radiative cooling from the foil faces, and/or flowing cooling fluids on the high-pressure face of the foil. The present invention, however, proposes to enclose one or more channels within a double foil window and to flow a cooling fluid through such channel(s). The window cooling rate is thus significantly improved over air convection because of fully-developed turbulent flow and a higher cooling mass transport through such channels(s). Calculations show that a 2–3 order-of-magnitude increase in the time-averaged particle beam current density can be realized while maintaining the physical integrity of the foil window by using the so cooled foil window of the present invention.

14 Claims, 6 Drawing Sheets

WINDOW WITH DENSE-PACKED
CENTER CHANNEL ARRANGEMENT

FIG. 4
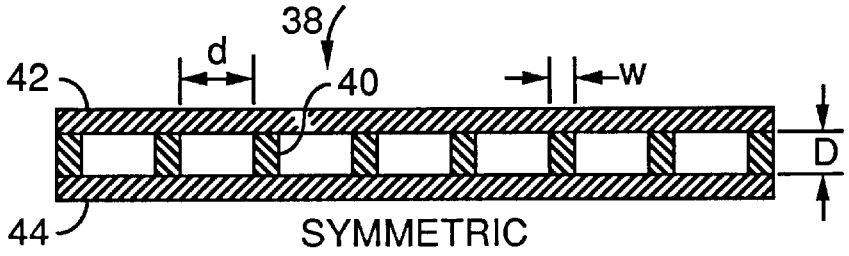
FIG. 5
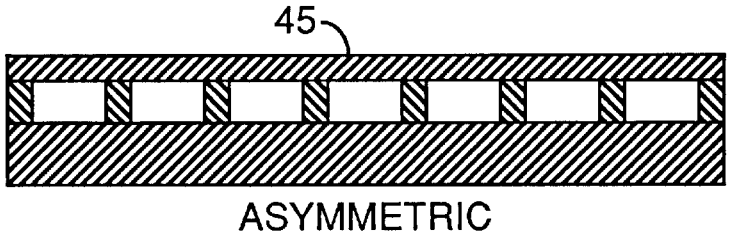
FIG. 6
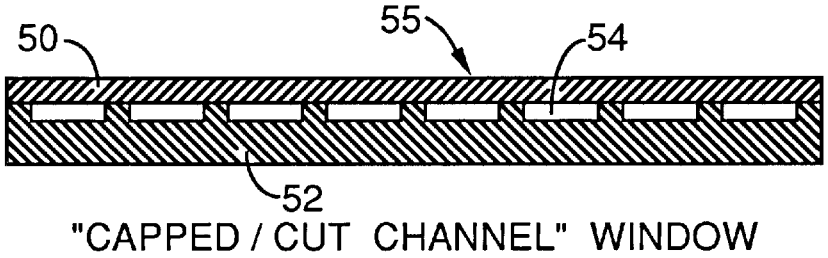
FIG. 7
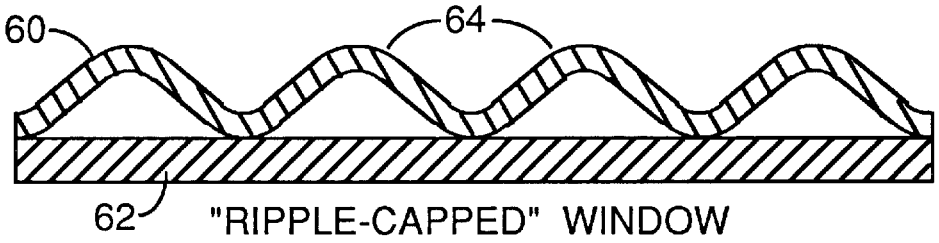
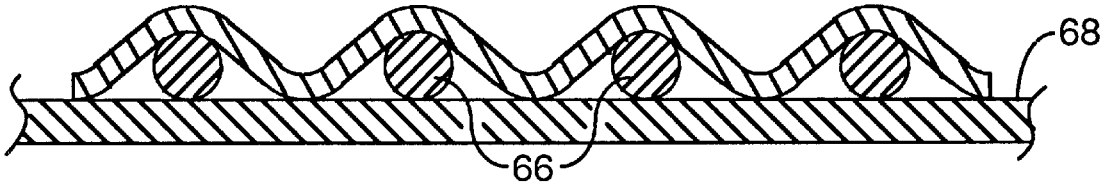
FIG. 8

SCHEMATIC OVERVIEW OF FLUID-COOLED PARTICLE-BEAM TRANSMISSION WINDOW SYSTEM

FLUID-COOLED PARTICLE-BEAM TRANSMISSION WINDOW

STATEMENT OF GOVERNMENT INTEREST

The invention described herein may be manufactured and used by or for the Government for governmental purposes without the payment of any royalty thereon.

FIELD OF THE INVENTION

This invention relates to a cooled particle beam transmission window, particularly one that is cooled by fluid flow.

BACKGROUND OF THE INVENTION

High fluence particle beams must be generated under vacuum or near-vacuum conditions. That is, major mechanisms for generating, ampere-to-kiloampere level particle beams must be immersed in a vacuum environment, with background gas pressures of, e.g. 0.0001 Torr or less. To transmit the particle beam to the open atmosphere or into a gas background at atmospheric pressure, it is necessary to pass the beam through some form of "interface" or "window", which is both strong enough to withstand a 14.7 pounds-per-square-inch pressure differential and thin enough to allow passage of the beam's particles with minimum degradation of particle energy and with minimum scattering. To-date this has been accomplished through the use of various thin foils of materials such as aluminum, titanium, beryllium, diamond, sapphire or a high tensile strength plastic such as polyester, e.g. "Mylar" or polyimide, e.g. "Kapton". Such window can typically sustain a steady-state electron beam current density of 10 microamperes per $cm^2$ at 150 keV before its ability to dissipate the heat influx is surpassed. Unfortunately, such low current densities limit practical applications. Electron-beam welding, for example, requires a minimum of 5 ma of continuous current. (For in-air welding, expensive pumping systems are used to transport the beam through a hole to the workpiece.). Thus, any attempt to pass a continuous beam of greater current density through existing foil windows results in a heating, softening, and rupturing of the foil window which destroys the vacuum environment necessary in the beam's generation region. Such failures can occur on microsecond timescales depending upon the specific foil material and energy deposition rate.

Attempts have been made in the prior art to cool such transmission window by circulating coolant through conduits proximate such window, see for example U.S. Pat. No. 5,235,239 to Jacob et al (1993), e.g. FIGS. 2 and 5A. In each case, coolant is circulated near a transmission window for indirect conductive cooling thereof through intervening structural members as shown, which limits the cooling effect thereof on such window. Also per FIG. 5A, the coolant system is located in a grid of support bars that block or cast shadows on the transmission window and absorb a significant portion of a particle beam passed therethrough.

There is thus a need for a cooling system for such transmission window that overcomes the above prior art shortcomings.

There has now been discovered a transmission window cooling system in which coolant directly cools the foils of such window, e.g. via convective heat transport with minimal absorption of the particle beam transmitted therethrough. At the same time per the invention, the coolant system is enclosed and pressurized to permit circulation of coolant therethrough for more effective cooling of such window.

SUMMARY OF THE INVENTION

Broadly the present invention provides a cooled transmission window for a particle beam generator which window comprises, a) two side-by-side metal foils which are joined together in portions thereof and spaced apart in other portions thereof, to define at least one cooling channel therebetween. Also provided are b) means for flowing coolant or cooling fluid under pressure through such channels for direct cooling of the foils and thus said window.

Preferably the coolant is flowed through the above channels under pressure for enhanced cooling of such windows.

Although the flow of coollant through the foil cooling channel can be laminar, it is preferred that such flow be at least slightly turbulant to more turbulant, for more effective cooling of the foils of the channel.

Various embodiments of the double foil window of the invention are described below.

BRIEF DESCRIPTION OF THE DRAWINGS

The invention will become more apparent from the following detailed specification and drawings in which;

FIGS. 4, 5 and 6 are fragmentary schematic sectional elevation views of other transmission window embodiments of the present invention;

FIGS. 7 and 8 are fragmentary schematic sectional elevation views of another embodiment of the transmission window of the invention;

DESCRIPTION OF PREFERRED EMBODIMENTS

Figure 1:
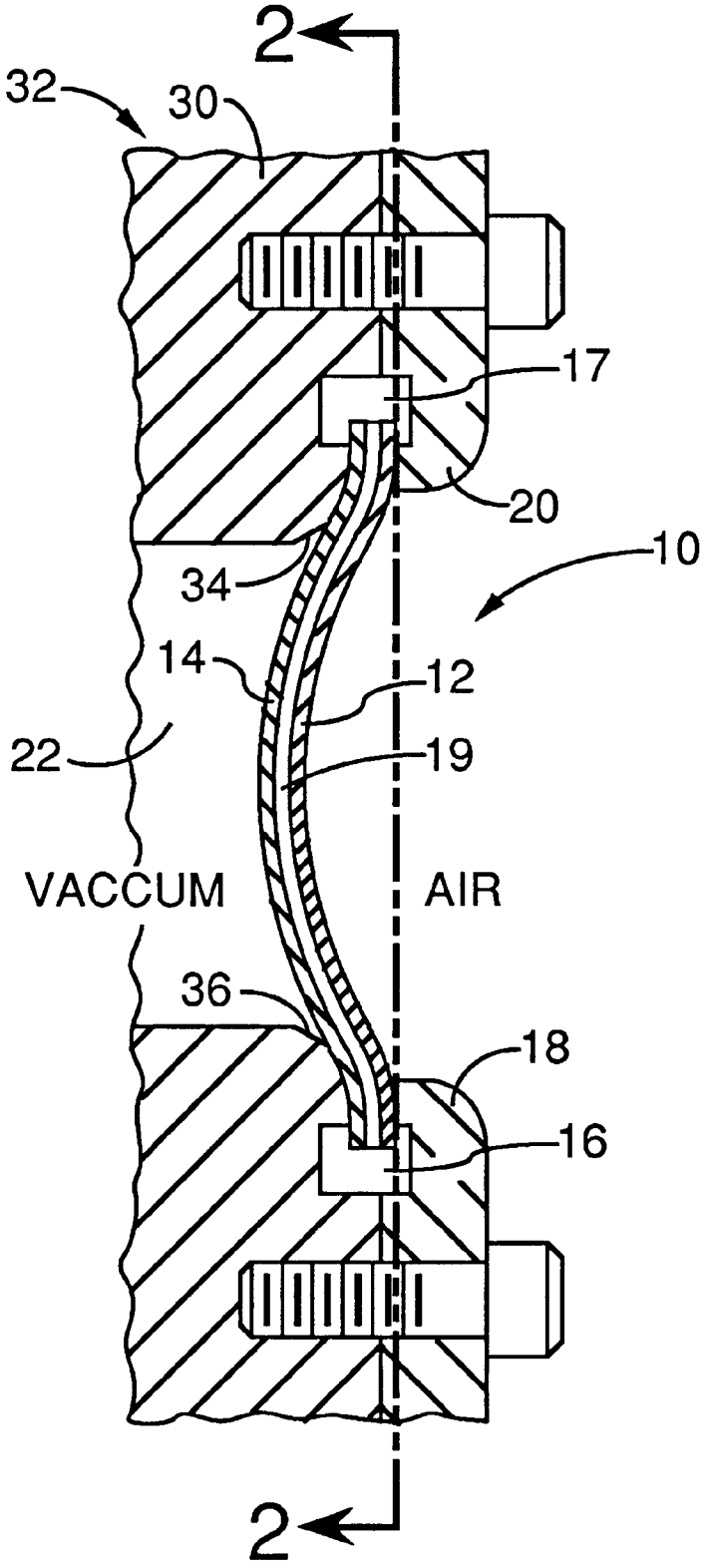
FIG. 1 is a fragmentary sectional elevation schematic view of a transmission window embodying the present invention.
Figure 2:
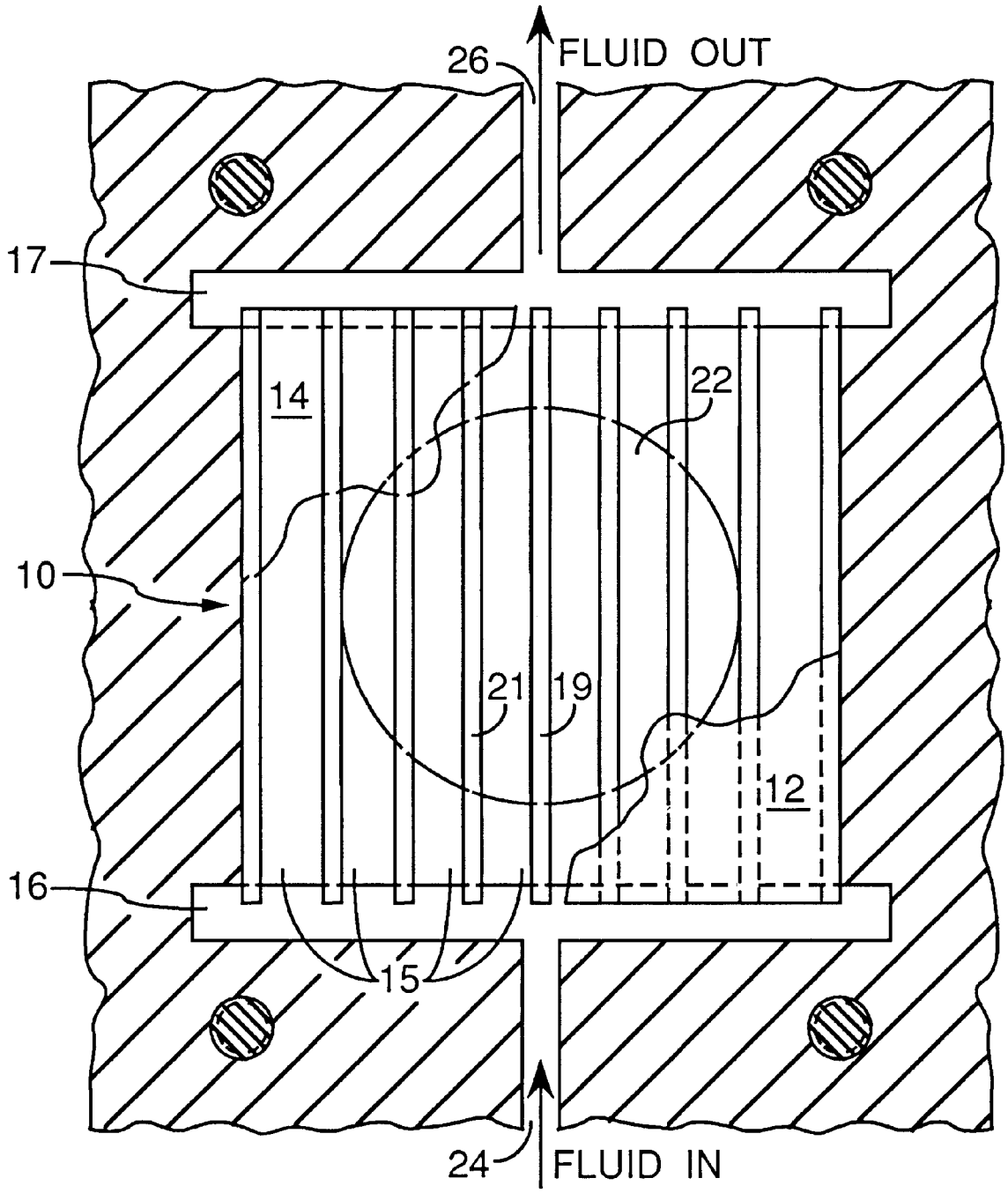
FIG. 2 is a fragmentary sectional schematic plan view of the transmission window of FIG. 1, taken on lines 2—2, looking in the direction of the arrows.

An embodiment of the transmission window of the invention 10 is shown in FIGS. 1 and 2, wherein two spaced foil members 12 and 14 (shown in part), are mounted in clamps 18 and 20, as shown in FIGS. 1 and 2. The transmission window 10 has a plurality of partitions such as partitions 19 and 21, defining coolant passages 15 therebetween, as shown or indicated in FIGS. 2 and 1. The coolant passages 15 communicate with cooling ducts 16 and 17 which in turn, communicate respectively with inlet duct 24 and outlet duct 26, as shown in FIG. 2 and in part in FIG. 1.

Also as indicated in FIG. 1, the double foil transmission window 10 is mounted by clamps 18 and 20 to the housing 30 of a particle beam generator 32 (not fully shown) as indicated in FIGS. 1 and 2. As shown in FIG. 1, the transmission window 10 is drawn toward the vacuum side of the housing 30 under pressure of the air side of such window per FIG. 1. To prevent pinching or scoring of such window 10, adjacent corners of the housings 30 have chamfered surfaces 34 and 36 as shown in FIG. 1.

For the purpose of illustrating the relative advantages of this invention, consider a uniform electron beam flowing through a 2-cm diameter transmission window whose temperature is thereby elevated to 570 degK. As previously stated, one surface of the window is typically exposed to only vacuum while the other is exposed to air. For a conventional, single-foil window, natural air heat convection from one vertical surface will dissipate 0.98 $W/cm^2$ and heat radiation from both its surfaces will be 2.56 $W/cm^2$. This yields a net 3.54 $W/cm^2$ of air convection/radiation cooling for a conventional window which does not have the pressurized cooling fluid system of this invention.

For a window based on this invention, either a gas or liquid may be used as the cooling fluid. Helium, for example, has a convective heat transfer coefficient of 3 $W/cm^2$-degK for a 1-mil diameter channel with a mass flow rate of 332×10(−9)kg/s, which yields a net cooling of 180 $W/cm^2$. Consequently, helium cooling using this invention is 50 times greater than natural air convection and radiation.

Liquid coolants, on the other had, are much more dense than gas and can transport significantly more heat per unit volume out of the transmission window. Water, for the same diameter tube, has a convective rate 78 $W/cm^2$-degK for a mass flow rate of 21×10(−6)kg/s, which yields a net cooling of 2.2 $kW/cm^2$ using this invention. That is 620 times greater than natural air convection and radiation. A high temperture oil could also be used as the cooling fluid although its thermal conductivity is only one-sixth that of water. Its higher temperature partially offsets this low conductivity and yields a net connective rate approximately half that of water. Oils offer the advantage of not corroding metal components as water would.

Maximum cooling rates are offered by a liquid metal, such as lithium. Its convective rate of 548 $W/cm^2$ at a mass flow rate of 6.8×10(−6) kg/s yields net cooling of 5 $kW/cm^2$. However, liquid metals are difficult to work with.

These examples indicate that liquids such as water, a high temperature oil, or a liquid metal, all yield cooling rates far superior to natural air convection and radiation. Optimization of the cooling channels, material properties, operating temperature, and pressure, predicts that cooling rates approximately three orders of magnitude above natural convection and radiation are possible using this invention compared to a conventional single-foil transmission window.

Figure 3:
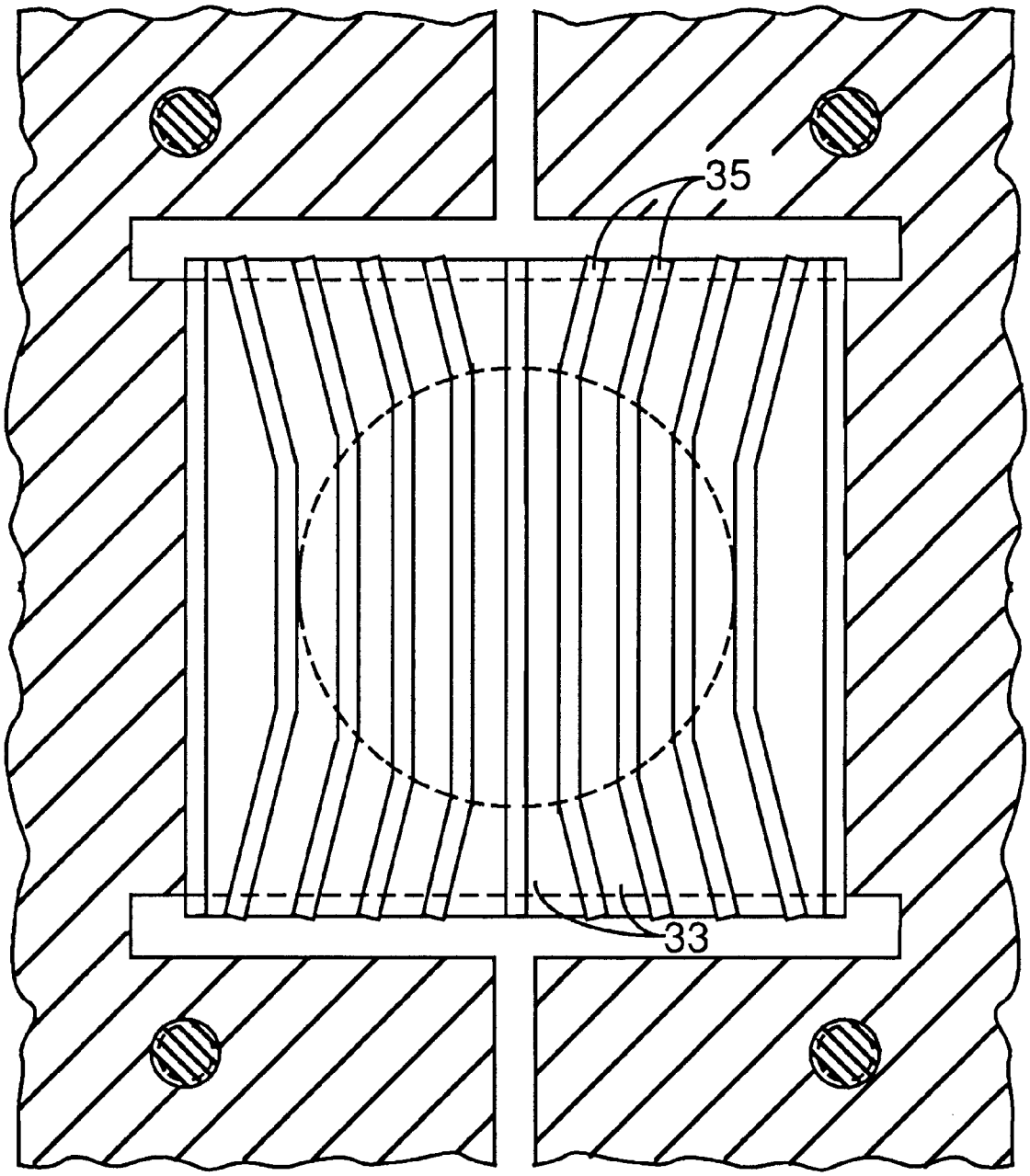
FIG. 3 is a fragmentary sectional schematic plan view of another transmission window embodying the present invention.

The above fluid transport preferably occurs through the entire volume of the window which can be intersected by the particle beam. The window channels need not necessarily impose a uniform fluid flow rate across the entire window cross-section. For example, per FIG. 3 herein, it can be advantageous to arrange the channels 33 between the partitions 35, such that fluid flow rates peak in the window's central region. That is where most of the intercepted beam's energy is likely to be deposited if the beam density has a typical Gaussian radial profile.

Numerous methods to achieve a fluid-cooled window configuration are possible. These can be arranged into four generic categories; barrier/channel sandwich, cut-and-capped channels, capped-ripple channels and simple-sandwich. Each of these four general methods for making the present invention are described below.

The first fabrication method, termed "barrier/channel sandwich" method, is illustrated in FIG. 4, wherein foil window 38 has partitions or barrier strips 40, bonded between two foils, 42 and 44. Note that the spacing, d, between the strips 40, need not be uniform. Also, the barrier width, w, and the spacing between the foils, D, need not be uniform throughout the window. It can be advantageous to fabricate the channels so as to maximize the cooling fluid flow rate through the central region of the window where most of the particle beam is intercepted. It is also possible to use different thicknesses for each of the two foils, to result in an "asymmetric" fluid-cooled transmission window 45, as illustrated in FIG. 5.

Each of the other three window fabrication styles listed below can also have an asymmetric manifestation. Further, an alternate configuration of this window method can employ the bonding of each barrier strip to only one of the opposing foil faces. This can cut the fabrication costs while still giving adequate control of turbulant fluid flow between the foils. However, this single-sided bond approach reduces the mechanical support given to the unbonded foil face and thereby increases the chances for mechanical failure.

In this and the other fabrication methods, the bonding techniques used for the partitions and/or channels must provide sufficient structural strength to withstand the hoop stress at the design pressure and temperature. This is achieved by increasing the surface area and utilizing a bonding technique to exceed the hoop stress specification at the design temperature. Appropriate techniques include brazing, resistance welding, rolling, soldering and plating.

The second fabrication method, termed the "capped-cut-channel" method is illustrated in FIG. 6. In this method, two foils, 50 and 52, are again used. Appropriate microfabrication techniques, e.g. masking and chemical etching, are used to cut parallel channels 54 into one of the foils 52. The two foils are then bonded together fluid-tight in such a way as to cap the cut channel, resulting in closed fluid conduits in double foil window 55. This method requires only single-sided bonding and optimizes mechanical support across the entire face of the window 55. As in the barrier-channel-sandwich method above, the channel and barrier widths and the resultant channel depths need not be uniform.

The third fabrication method discussed herein is the "ripple-capped" method. It is illustrated in FIG. 7. Here, two foils 60 and 62 are also used. One of the foils 60 however, is now corrugated with parallel ripples 64 running along one dimension. One method for achieving the desired corrugation is illustrated in FIG. 8. One of the foils is placed over an array of parallel fine wires 66, such as commonly used for radiofrequency polarization grids. The wire array, in turn, lies on a hard, flat surface 68. Pressure is then applied to the exposed foil face using, for example, a malleable roller (not shown) to push the foil down into the spaces between the wires. The resultant corrugated foil is then bonded to the second, flat foil along the troughs of the corrugations per FIG. 7. What results, once again, are closed linear fluid flow channels. In this method also, techniques such as choosing variable wire diameters and spacing in the forming process can result in nonuniform channel width and spacing, if desired. Also the ripple-formation process described above can be combined with a simultaneous pressure-bonding process, to be accomplished in a single step.

Figure 9:
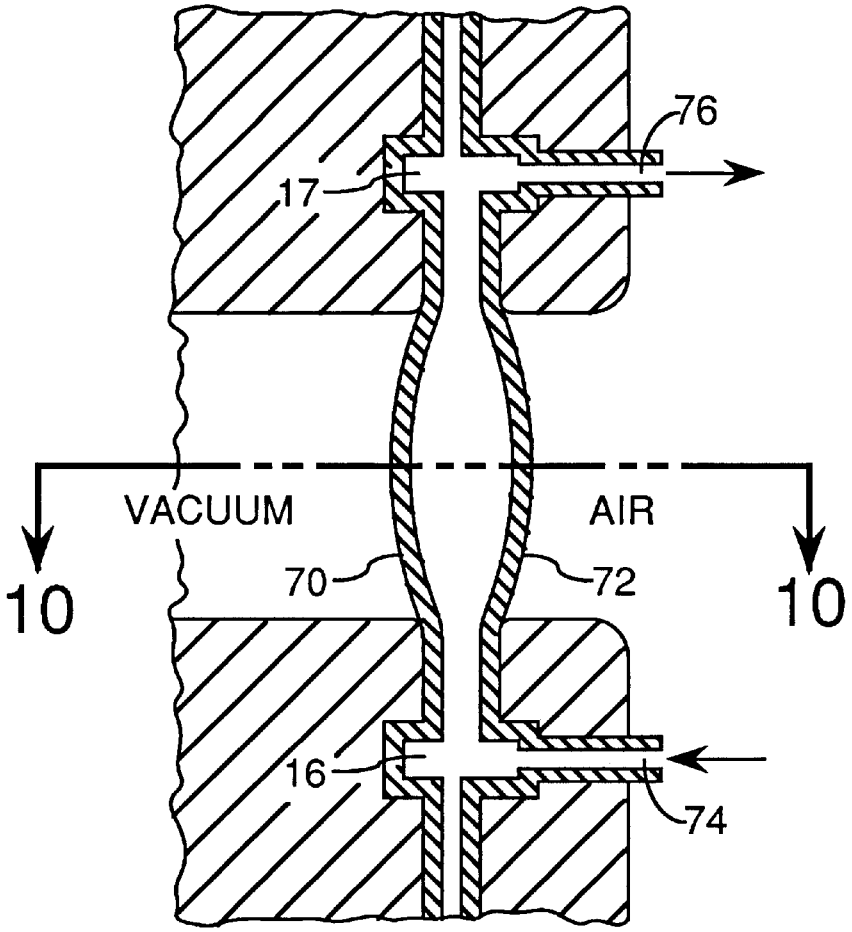
FIG. 9 is a fragmentary schematic sectional elevation view of another transmission window embodying the invention.
Figure 10:
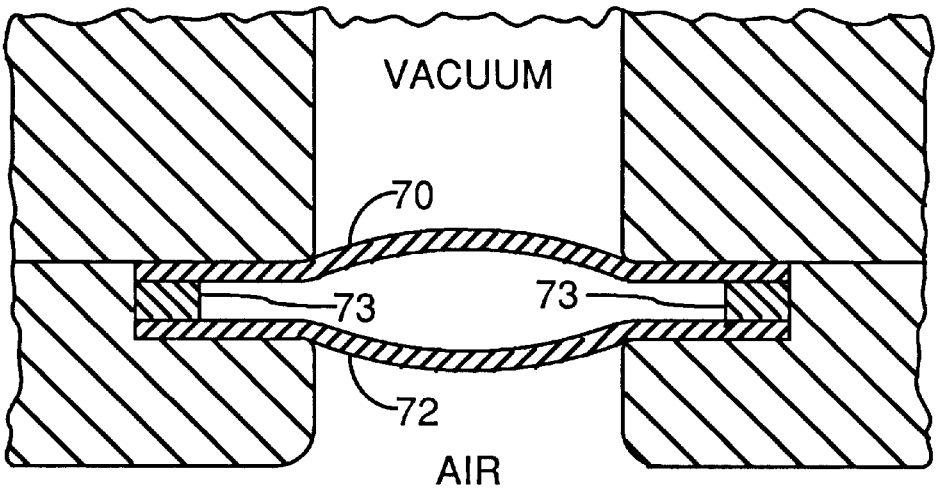
FIG. 10 is a fragmentary schematic sectional plan view of the transmission window embodiment of FIG. 9 taken on lines 10—10, looking in the direction of the arrows

Finally, the "simple-sandwich" method for fabricating the fluid-cooled transmission window is illustrated in FIGS. 9 and 10. In this method two foils 70 and 72 are placed back-to-back with, e.g. a sub-mil of empty space between them. The two foils can be of different thicknesses. They are bonded at opposing ends to spacer-strips 73, of desired thickness. Alternatively, a single foil of double width can be folded in half, in which case only the open-side spacer-strip need be bonded securely enough to withstand the full fluid pressure. This arrangement effectively forms a single, highly elongated channel transmitting nearly the full volume of the resulting window. An inlet manifold 74 and an outlet manifold, 76, are bonded fluid-tight to the opposing open ends of the elongated channel as shown. A predetermined fluid input pressure is maintained by any appropriate means, such as a fluid pump (not shown) in the input manifold, to ensure adequate fluid flow rate through the window volume. However, such envelope is subject to stress due to the pressure differential between the pressurized internal cooling fluid and the external vacuum and atmospheric surroundings on opposite foil faces. Bulging of each foil face at the center can be expected. This bulging increases the net window thickness which increases heat absorption but decreases fluid velocity. This bulging can also grow to a failure condition, depending upon the working pressure parameters, foil thickness, operating temperatures and foil material. This hoop stress may well limit use of the simple-sandwich method to small diameter (e.g 1–2 mm) windows.

Figure 11:
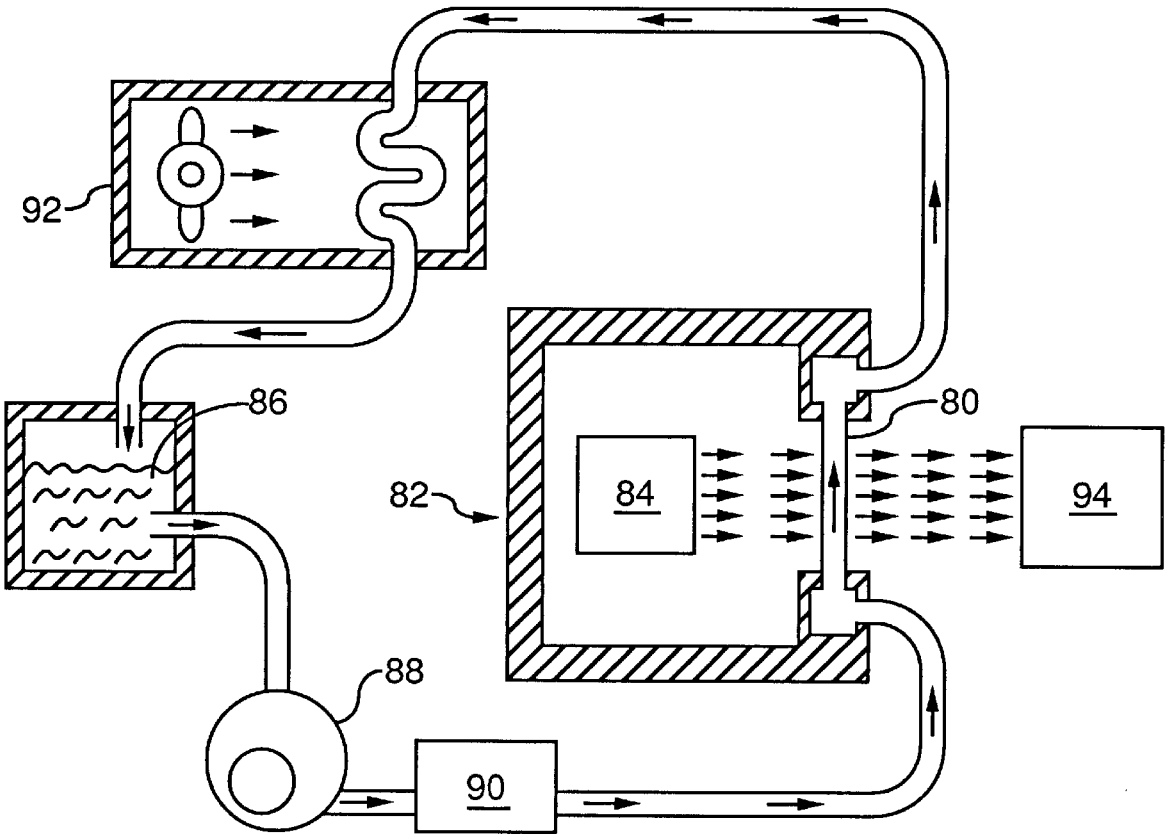
FIG. 11 is a schematic sectional elevation view of a particle beam generating system incorporating a transmission window embodying the present invention.

The use of this invention is illustrated in FIG. 11. The channeled, fluid-cooled, double foil window 80 fabricated by any of the methods described above, is incorporated as an integral, vacuum-tight, part of the particle-beam source vacuum vessel 82. The window must be located downstream of the particle beam source 84, contained within that vessel. It must be placed in such a position so as to be transverse to the particle-beam axis and to completely encompass the useful cross-section of the particle-beam within its physical extent. The description up to this point describes the configuration of any particle-beam transmission window, including those available prior to this invention.

Also novel in this invention is the addition of a fluid-cooling subsystem within the transmission window 80. The overall fluid-cooling system starts with the cooling fluid reservoir 86, which stores the working fluid. Fluid is drawn from the reservoir 86 by the fluid pump 88, and forced at some working pressure into a microfine particulate filter 90. The filtering is necessary to minimize chances of fluid-borne particles clogging one or more of the microchannels running through the window. After filtering, the fluid, continues into the inlet manifold of the channeled, fluid-cooled window 80. The fluid extracts excess heat from the window as it flows through its internal channels. The fluid carries that heat to a heat dissipation unit 92, where it transfers the heat to the environment and the working fluid returns to its lower input operating temperature. The heat dissipation unit can use a conventional liquid-air or liquid-liquid heat exchange device (such as a radiator) to transfer the excess fluid heat to either a background air flow or to a main water flow. When used with the above new fluid cooling system, the particle-beam transmission window will transmit a high fluence particle-beam into a beam-application area 94, at (or above) atmospheric pressure in a steady-state, continuous fashion, which is up to three orders-of-magnitude greater than conventionally cooled windows. Although the current density that can be transmitted in pulsed mode operation is not affected, the duty cycle will be significantly increased up to three orders-of-magnitude because natural cooling is augmented by efficient forced cooling.

Thus the invention provides an improved transmission window for the practical extraction of high fluence charged-particle-beams from a vacuum or near-vacuum environment into an environment near, at, or above atmospheric pressure. These charged-particle beams can be either electron-beams or ion-beams, referred to herein as "particlebeams." This is important because available high-fluence particle-beam sources function best under vacuum or near-vacuum conditions. Therefore, in order to apply such beams to real-world uses in the open atmosphere, a practical method has been sought for their extraction from the vacuum system. Thus the present invention can permit superior electron-beam welding in air. It can permit fast feed-rate welding of large structures that cannot fit into the vacuum chamber of a traditional electron-beam welding system. In the medical field, this invention can permit electron-beam surgery and possible particle-beam cancer treatments. Toxic waste remediation concepts can benefit from the high beam currents which can significantly enhance their system processing rate. For the military, this invention can directly contribute, to potential directed-energy weapons concepts.

An important novelty of the present invention is the direct contact cooling of the foil window by a coolant. That is, a cooling fluid is forced between the foils that define the double foil window of the invention, e.g. in FIG. 11 or through microchannels thereof, e.g. as shown in FIG. 7 hereof. Such fluid flows at high velocity and high pressure along the foil and carries away the heat deposited into the foil by the beam. The physical processes exploited are fully-developed turbulence, convective heat transfer, and mass transport. As noted above, the internal forced-fluid cooling method of the invention promises the ability to handle up to 2–3 orders-of-magnitude greater particle beam current density as compared to conventional foil cooling techniques without internal cooling channels.

Although the additional foil thickness for the transmission window of the present invention increases the energy deposited in the window by approximately 25%, over that of a one foil transmission window, it is expected that a 2–3 order-of-magnitude increase in the steady-state particle beam current density can be realized while maintaining the integrity of the foil window, using the cooled transmission windows of the present invention. This, for example, can permit the transmission of up to 30 ma, which exceeds the 5 ma minimum continuous electron beam current necessary for practical electron beam welding applications. Hence, high feed-rate electron-beam welding in air is possible without expensive pumping systems.

Thus an important advantage of the double foil transmission window of the present invention is its ability to transmit a high current density particle-beam from its vacuum (or near vacuum) generation source environment, out into an atmospheric (or greater) pressure environment. This advantage opens up new applications of intense particle beams in non-vacuum environments.

Also the double foil transmission window of the invention, with a single flow path or a plurality of flow channels therein, permits direct convective fluid-cooling of the window material, prevents mechanical failure due to overheating and permits the increase of transmitted particle flux by 2–3 orders of magnitude as noted above.

What is claimed is:

1. A cooled transmission window for a particle-beam generator which window comprises, a) two side-by-side metal foils which are joined together at portions thereof and spaced apart at other portions thereof to define at least one cooling channel therebetween and b) means for flowing cooling liquid under pressure through said channels for direct cooling of said foils and thus said window.

2. The window of claim 1 having pump means to circulate said cooling liquid in said channel for convective cooling thereof.

3. The window of claim 1 wherein said two foils are connected by spaced partitions which define cooling channels therebetween.

4. The window of claim 1 wherein at least one of said foils has side-by-side spaced grooves etched therein to define a plurality of cooling microchannels.

5. The window of claim 4 wherein only one of said foils is grooved with ridges therebetween and the other of said foils rests atop said ridges to cap said grooves.

6. The window of claim 1 wherein one of said foils has side-by-side ripples therein, which foil rests on and is capped by said other foil to define cooling channels therebetween.

7. The window of claim 1 wherein said foils are connected at a pair of opposed edges thereof to define a single continuous cooling channel therebetween.

8. The window of claim 1 having foils of metal selected from the group consisting of aluminum, titanium, sapphire, copper, berylium, tungsten, gold, and platinum.

9. The window of claim 1 wherein said cooling liquid is selected from the group consisting of water, oil and liquid metal.

10. The window of the claim 9 wherein said cooling liquid is selected from the group consisting of helium and liquid lithium.

11. A method for obtaining an increased flux output from a particle generator comprising, a) providing two side-by-side metal foils which are joined together portions thereof and spaced apart and other portions thereof to provide at least one cooling channel therebetween, and define a double foil window, which window is located at the exit port of said generator, b) flowing cooling liquid through said channel under pressure in direct contact with the surfaces of the two foils to cool same and c) generating an increased flux particle beam without overheating said window due to the above cooling step.

12. The method of claim 11 wherein the liquid flow convectively cools the surface of said two foils.

13. The method of claim 11 wherein said liquid is pumped under pressure for turbulent flow to further cool said double foil window.

14. The method of claim 11 wherein the double foil window has a plurality of side-by-side channels therein for reinforced cooling of said window.

* * * * *